United States Patent [19]

House

[11] 4,126,248

[45] Nov. 21, 1978

[54] ADJUSTABLE CUP DISPENSER

[75] Inventor: Bruce F. House, Miami, Fla.

[73] Assignee: Shelley Manufacturing Company, Division of Alco Foodservice Equipment, Miami, Fla.

[21] Appl. No.: 813,084

[22] Filed: Jul. 5, 1977

Related U.S. Application Data

[63] Continuation-in-part of Ser. No. 642,783, Dec. 22, 1975, Pat. No. 4,033,478.

[51] Int. Cl.[2] ..... B65H 31/20

[52] U.S. Cl. ..... 221/241; 221/279; 221/310

[58] Field of Search ..... 221/279, 280, 303, 307, 221/310, 221, 223, 151, 152, 297, 241, 242, 244, 63

[56] References Cited

U.S. PATENT DOCUMENTS

| | | | |
|---|---|---|---|
| 3,203,587 | 8/1965 | Mount et al. | 221/279 |
| 3,265,243 | 8/1966 | Velter | 221/242 |
| 3,295,718 | 1/1967 | Graham | 221/63 |
| 4,033,478 | 7/1977 | House | 221/279 |

*Primary Examiner*—Robert B. Reeves
*Assistant Examiner*—H. Grant Skaggs
*Attorney, Agent, or Firm*—Ernest H. Schmidt

[57] ABSTRACT

A cylindrical, vertically extending container having an interior, spring-pressed pressure head is adapted resiliently to constrain inverted stacks of paper cups upwardly against a plurality of radially-inwardly-extending, downwardly-directed, arcuate leaf springs, the upper ends of which springs are secured against upper end portions of the container in peripherally-spaced relation, and the lower ends of which springs extend through side openings in the container and are attached to an adjusting collar slidably disposed with respect to the outside of the container. A screwdriver adjustment mechanism serves to positionally adjust the adjusting collar with respect to the container to provide for various degrees of inward flexure of the springs for accommodating a wide variety of sizes, selectively, of paper cups to be dispensed.

6 Claims, 4 Drawing Figures

ADJUSTABLE CUP DISPENSER

This application is a continuation-in-part of my patent application Ser. No. 642,783, filed Dec. 22, 1975, titled "CUP DISPENSER" now issued as U.S. Pat. No. 4,033,478 on July 5, 1977.

In that application there is described a cup dispenser that presents cups from below for dispensing at the top of the container in which they are stacked, whereby the container can be suspended from its upper end through an opening in the counter top of a servling line, for example, for counter top dispensing. A spring-pressed pressure head within the container resiliently constrains an inverted stack of paper cups against a plurality of radially-inwardly-extending, downwardly-directed arcuate leaf springs the upper ends of which are secured against upper end portions of a cylindrical container in which the cups are stacked, and the lower ends of which extend through side openings in the container for movement therethru, whereby free flexure of the leaf spring is permitted upon upward withdrawal, one at a time, of the stacked cups. My present invention is directed to improvement, in that construction adapting the cup dispenser to use, selectively, with any one of a wide range of diametric sizes of stacked cups to be dispensed by use of a simple adjustment mechanism.

The principal object of this invention, accordingly, is to provide a cup dispenser of the type described in my above identified co-pending patent application wherein the lower end of the arcuate leaf springs are cooperatively joined with a common adjusting collar or sleeve slidably disposed about the outside of the container and positionally adjustable therealong for varying the inwardly fixed positions of the arcuate leaf springs to accommodate various diameters, selectively, of stacked cups to be dispensed.

A more particular object of this invention is to provide an adjustable cup dispenser of the character described wherein positional adjustment of the adjusting collar is effected by a simple screw adjustment made by use of a screwdriver applied through the top opening of the adjustable cup dispenser.

Another object of the invention is to provide an adjustable cup dispenser of the above nature which will be simple in construction, easy to adjust, reload and clean, attractive in appearance ad durable in use.

Other objects, features and advantages of the invention will be apparent from the following description when read with reference to the accompanying drawings. In the drawings, wherein like reference numerals denote corresponding parts throughout the several views.

Figure 1:
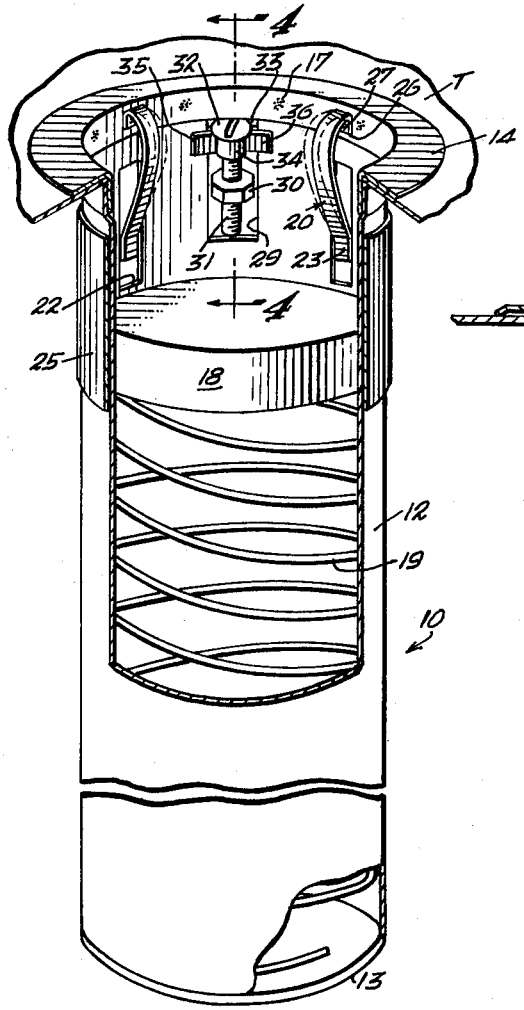
FIG. 1 is an oblique view, as seen from above, with portions broken away to illustrate constructional details of a preferred from of adjustable cup dispenser embodying the invention.
Figure 3:
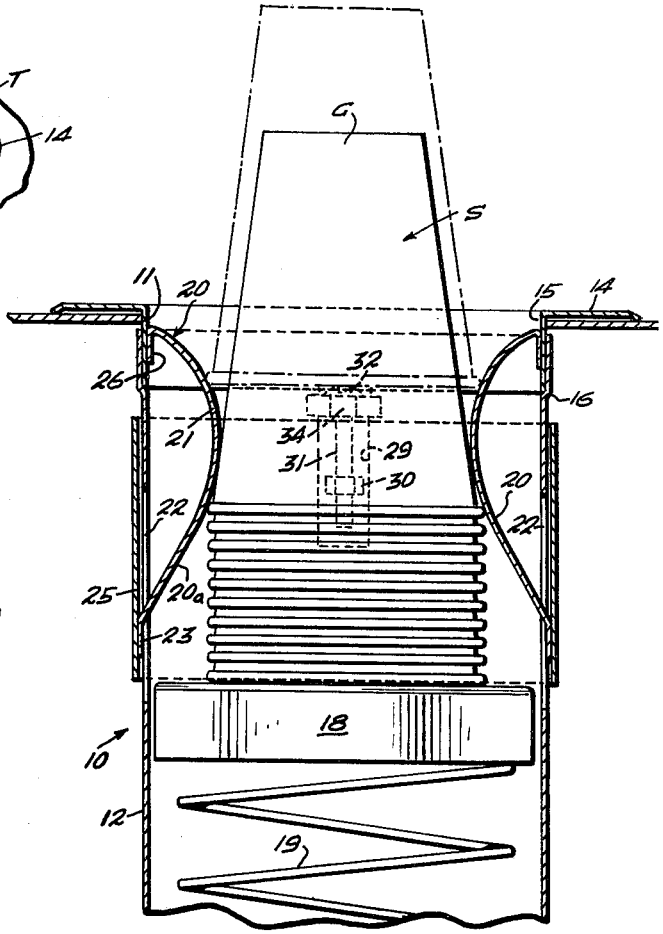
Figure 2:
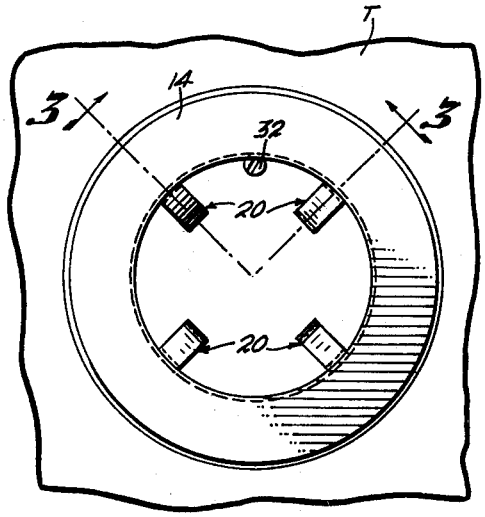
FIG. 2 is a top view thereof.
Figure 4:
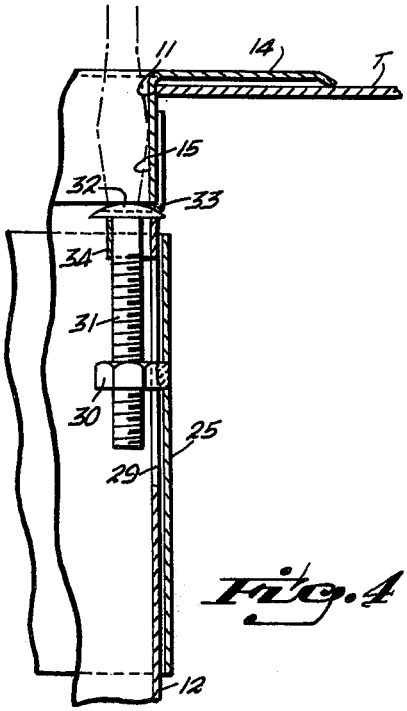

FIG. 3 is a partial, vertical cross-sectional view, taken along the broken line 3—3 of FIG. 2 in the direction of the arrows, on an enlarged scale and showing the dispenser loaded with a stack of paper cups for self service dispensing; and FIG. 4 is a fragmentary, vertical cross-sectional view taken along the line 4—4 of FIG. 1 in the direction of the arrows and illustrating assembly details of the adjustable cup dispenser and its operating mechanism.

Referring now in detail to the drawings, reference numeral 10 designates, generally, an adjustable cup dispenser embodying the present invention, the same being illustrated as supported upon a serving line counter top T having a suitable circular opening 11 in which it is removably received. The cup dispenser 10 comprises an elongated, cylindrical, vertically-extending tank or container 12, preferably fabricated of stainless steel, enclosed at the bottom as by a cylindrical cap 13 spot-welded or otherwise secured thereat. The upper end of the container 12 has secured thereto a radially-outwardly-extending annular flange 14. The flange 14, which is also preferably of stainless steel, is integrally formed with an inner, coaxial, peripheral skirt portion 15, the interior surface of which is cylindrical and of substantially the same internal diameter as that of the container 12. The marginal upper end portion of the container 12 is peripherally offset, as indicated at 16, to define a somewhat increased internal diameter sufficient to slidingly receive, in interfitting relation, the skirt portion 15 of the flange 14, said container and flange being permanently affixed to one another as by a plurality of spot welds 17.

Slidably disposed within the container 12 is a cylindrically-skirted, circular pressure head 18 which is resiliently urged in the upward direction of said container by a helical compression spring 19 constrained between the underside of said pressure head and the bottom cylindrical cap 13 at the lower end of said container upon which said spring is seated.

Means is provided for the manual withdrawing, one at a time, of stacked paper cups S supported upside-down upon the pressure head 18. To this end, a plurality of arcuate leaf springs 20 extend inwardly of the flange 14 at one end to curve downwardly and radially inwardly, as indicated at 21, ultimately to project through elongated side openings 22 in the container 12 whereat they terminate in downwardly-bent end portions 23. The downwardly bent end portions 23 are spot welded or otherwise securely fixed to lower inner surface portions of a cylindrical adjusting collar or sleeve 25 slidably disposed about the cylindrical container 12 near the upper end thereof. The upper end of the arcuate leaf springs 20 terminate in downwardly-extending flat portions 26 which are secured to inner wall portions of the flange skirt 15 as by spot welds 27. As is hereinafter more particularly described, the elongated side openings 22 through which the arcuate leaf springs 20 extend are long enough to permit substantial up and down sliding movement of the adjusting sleeve or collar 25 with respect to container 12 to provide for concomitant in and out flexure of said leaf spring for adjustment purposes.

Means is provided for positionally adjusting sleeve 25 with respect to container 12. For this purpose, an upper end portion of the container 12 is provided with an elongated through opening 29 through which projects a nut member 30 secured, as by welding, to an inner wall portion of the adjusting sleeve or collar 25. An adjustment screw 31 threadingly engaged with the nut 30 extends upwardly within the container 12 to terminate in increased-diameter head portion 32 partially received in a slot opening 33 formed in said container at a position directly below the lower edge of flange skirt portion 15. A U-shaped bracket 34 serves to freely clamp an upper end portion of the adjustment screw 31 in place, said clamp being arranged in straddling relation with respect to an upper end portion of container through opening 29 and having opposed bracket arm portion 35, 36 spot welded or otherwise secured with respect to said container. In this connection it will be understood that the slot opening 33 together with the U-shaped bracket 34 serve to constrain the adjustment screw 31 to rotary movement with respect to the container 12. Thus, turning the adjustment screw 31 in one direction or the other such as by use of a screwdriver (partially illustrated), serves to raise or lower its associated nut member 30 and consequently raise or lower the adjustment collar or sleeve 25 with respect to the container 12. As described above, turning the adjustment screw 31 to such direction as will raise the adjusting sleeve or collar 25 serves to flex the arcuate leaf springs 20 in the inward direction, for example: from the full-line position thereof as illustrated in FIG. 1 to the position as illustrated by the broken-line representations thereof.

Referring now to FIG. 2 and considering the operation of the cup dispenser, it will be understood that the uppermost protruding cup C is withdrawn the bead or lip at the open end of the cup, in moving outwardly of the container 12, will cause the leaf springs 20 to flex inwardly to a degree just sufficient to permit passage beyond the springs, as illustrated by the broken-line representation thereof, whereat the cup can be freely removed from the stack for use. Since upper and lower ends of the springs are in fixed positions, for such flexure of the springs to occur, a slight inward distortion thereof will take place at zones in contact with the uppermost cup. Since the lower portions 20a of the leaf springs 20 are relatively straight, distortion for passage of the uppermost cup will result in slight inward bowing of said lower end portions. In this connection it will be understood that adjustment of adjustment screw 31 as described above not only provides for dispensing frusto-conical cups of various sizes, that is, having a wide range of diameters at their upper or open end, but also provides for fine adjustment of the degree of resistance desired in the dispensing, one at a time, of cups of any selected diameter within the range of use of the adjustable cup dispenser.

While I have illustrated and described herein only one form in which my invention can conveniently be embodied in practice, it is to be understood that this form is given by way of example only, and not in a limiting sense. The invention, in brief, comprises all the embodiments and modifications coming within the scope and spirit of the following claims.

What I claim as new and desire to secure by Letters Patent is:

1. An adjustable self service dispenser for disposable paper cups and the like comprising, in combination, a vertically-extending, open-top container, a plurality of arcuate leaf springs arranged within the upper end of said container in radially-inwardly-extending, downwardly-directed disposition, means for securing the upper ends of said springs with respect to the upper end of said container in peripherally-spaced relation thereabout, a plurality of side openings in said container, one for each of said leaf springs, the lower ends of said arcuate leaf springs extending one each through said side openings an adjusting sleeve circumjacent said container and slidably movable with respect thereto over the zone of said container side openings, the lower ends of said leaf springs each being secured to inner portions of said sleeve, means for adjusting the axial position of said sleeve relative to said container to change the degree of flexure of said springs to accommodate different diameter sizes of cups to be dispensed, and means for resiliently urging upside-down, stacked, frusto-conical cups in said container in the upward direction so that the peripheral lower end of the uppermost cup of the stack contacts underside portions of said arcuate leaf springs, said leaf springs being of such size and so positioned at the upper end of said container that the uppermost cup of the stack will project outwardly of the upper end of said container for convenient grasping for removal during a self service cup dispensing operation.

2. An adjustable self service dispenser as defined in claim 1, wherein said sleeve axial positioning means comprises a screw nut member secured to said sleeve with the central axis of its threaded opening parallel with the axis of symmetry of said sleeve, an adjustment screw threadingly received in said nut member, and means constraining said adjustment screw to rotary motion with respect to said container.

3. An adjustable self service dispenser as defined in claim 2, wherein said sleeve positioning means further comprises an opening in said container through which said screw nut member extends, and wherein said constraining means comprises a U-shaped bracket embracing and positioning said adjustment screw along the inside of said container, said adjustment screw having a screwdriver receiving head at its upper end accessible for screwdriver adjustment through the upper end of said open-top container.

4. An adjustable self service dispenser as defined in claim 3, wherein said means constraining said adjustment screw with respect to said container further comprises a slot opening in said container within which a peripheral edge portion of said adjustment screw head is received.

5. An adjustable self service dispenser as defined in claim 3, including an annular flange secured to and extending outwardly of the upper end of said container, and wherein said means for resiliently urging stacked cups in said container in the upward direction comprises a cylindrically skirted pressure head slidably fitted in said container, spring seating means at the lower end of said container, and a helical compression spring constrained between said spring seating means and the underside of said pressure head.

6. An adjustable self service dispenser as defined in claim 5, wherein said annular flange is integrally formed with an inner cylindrical skirt telescopingly secured within a marginal upper end portion of said container, wherein said means for securing the upper ends of said leaf springs with respect to the upper end portion of said container comprises spot welds securing terminal upper end portions of said leaf springs to the inside of said flange skirt.

* * * * *